US011448069B2

(12) United States Patent
Peardon

(10) Patent No.: US 11,448,069 B2
(45) Date of Patent: Sep. 20, 2022

(54) TUNNEL BORING MACHINE

(71) Applicant: Malcolm John Peardon, Queensland (AU)

(72) Inventor: Malcolm John Peardon, Queensland (AU)

( * ) Notice: Subject to any disclaimer, the term of this patent is extended or adjusted under 35 U.S.C. 154(b) by 0 days.

(21) Appl. No.: 16/637,657

(22) PCT Filed: Aug. 1, 2018

(86) PCT No.: PCT/AU2018/050800

§ 371 (c)(1),
(2) Date: Feb. 7, 2020

(87) PCT Pub. No.: WO2019/028495

PCT Pub. Date: Feb. 14, 2019

(65) Prior Publication Data

US 2021/0148230 A1 May 20, 2021

(30) Foreign Application Priority Data

Aug. 8, 2017 (AU) ..... 2017903145

(51) Int. Cl.
*E21D 9/11* (2006.01)
*E21D 9/087* (2006.01)

(52) U.S. Cl.
CPC ..... *E21D 9/112* (2013.01); *E21D 9/087* (2013.01); *E21D 9/113* (2013.01)

(58) Field of Classification Search
CPC ... E21D 9/1053; E21D 9/0642; E21D 9/0657; E21D 9/087; E21D 9/113; E21D 9/06; E21D 9/0692; E21D 9/08; E21D 9/10; E21D 9/106; E21D 9/11; E21D 9/112
See application file for complete search history.

(56) References Cited

U.S. PATENT DOCUMENTS 1,333,491 A 3/1920 Hughes
1,453,620 A * 5/1923 Carlson ..... E21D 9/1053 175/94
2,798,707 A 7/1957 Kandle
(Continued)

OTHER PUBLICATIONS

International Search Report and Written Opinion for Application No. PCT/AU2018/050800 dated Nov. 1, 2018.

*Primary Examiner* — Abby J Flynn
*Assistant Examiner* — Michael A Goodwin
(74) *Attorney, Agent, or Firm* — Tumey L.L.P.

(57) ABSTRACT

A tunnel boring machine for boring a tunnel in rock including: locating means mounted to a frame for supporting and locating the frame in a disposition with respect to a tunnel axis and a boring face of the tunnel being bored; a first boring assembly operatively associated with said frame for boring into an annular face surrounding a core substantially coaxial with the tunnel axis, the annular face being a portion of the boring face; a core removal assembly operatively associated with said frame and disposed axially with respect to said first boring assembly away from the annular face, said core removal assembly being operable for removing at the core exposed by the first boring assembly transverse to the tunnel axis to expose the remainder of the boring face; and drive means operatively associated with said first boring assembly for driving said boring assembly into the annular face.

21 Claims, 8 Drawing Sheets

(56) References Cited

U.S. PATENT DOCUMENTS

| | | | | |
|---|---|---|---|---|
| 2,979,318 | A * | 4/1961 | Haspert | E21D 9/1053 299/15 |
| 3,325,217 | A | 6/1967 | Enz | |
| 3,379,264 | A | 4/1968 | Cox | |
| 3,507,540 | A * | 4/1970 | Silverman | E21C 37/12 299/15 |
| 4,013,319 | A * | 3/1977 | Wise | E21D 9/08 299/31 |
| 4,260,194 | A * | 4/1981 | Blindow | E21D 9/1053 175/15 |
| 2013/0076100 | A1 | 3/2013 | Takeda et al. | |
| 2015/0174789 | A1 * | 6/2015 | Alsadah | E21D 9/1053 299/15 |

* cited by examiner

TUNNEL BORING MACHINE

FIELD OF INVENTION

This invention relates to a tunnel boring machine. The invention has particular application to a tunnel boring machine for boring tunnels through rock or stone strata for underground roadway or railway infrastructure but may have application to other tunnel boring applications through rock, such as for water or wastewater transport.

BACKGROUND ART

Tunneling through rock is normally done using a set of drills or borers mounted to engage a rock face, thereby producing a series of holes in rough alignment with the intended extremity of the tunnel walls. Once the holes are at a predetermined depth the intervening rock is split from the rock face.

Tunnel boring machines for rock and hard rock typically have a plurality of cutting heads arranged for cutting into the cutting face of the tunnel by rotation of a cutting head. With large diameter tunnels, the linear speed of the cutting heads at the periphery is significantly higher than the cutting heads near the centre, thereby limiting boring speeds. Additionally, a large proportion of rock to be removed is required to be removed by the cutting heads themselves, thereby requiring more pulverisation that may be necessary.

The present invention aims to provide a rock boring apparatus which addresses the abovementioned shortcomings and which may be used for tunneling into rock or to provide an alternative to existing rock tunneling borers. Other aims and advantages of the invention may become apparent from the following description.

DISCLOSURE OF THE INVENTION

With the foregoing in view, the present invention in one aspect resides broadly in a tunnel boring machine for boring a tunnel in rock including:

locating means mounted to a frame for supporting and locating the frame in a disposition with respect to a tunnel axis and a boring face of the tunnel being bored;

a first boring assembly operatively associated with said frame for boring into an annular face surrounding a core substantially coaxial with the tunnel axis, the annular face being a portion of the boring face;

a core removal assembly operatively associated with said frame and disposed axially with respect to said first boring assembly away from the annular face, said core removal assembly being operable for removing the core exposed by the first boring assembly transverse to the tunnel axis to expose the remainder of the boring face; and drive means operatively associated with said first boring assembly for driving said boring assembly into the annular face.

Preferably, the core removal assembly include a core rupturing assembly for rupturing the core into rock fragments of a size greater that rock fragments produced by the operation of the boring assembly. Alternatively, the core removal assembly includes a second boring assembly operable separately from the first boring assembly.

In another aspect, the present invention resides broadly in a method of boring a tunnel through rock including:

locating a tunnel boring machine in a disposition with respect to a boring face of the tunnel being bored and in alignment with a tunnel axis transverse to the boring face;

boring an annular face into the boring face substantially coaxial with the tunnel axis to expose a core, the annular face being a portion of the boring face and the core being the remainder of the boring face;

rupturing the core exposed by boring into the annular face; and driving the boring assembly into the boring face.

The material ruptured by the rupturing means is typically of a larger size than the other material removed from the boring face and may be comminuted prior to being extracted from the vicinity of the boring face. The rupturing means is preferably provided by opposed pairs of pincers akin to those provided in hydraulic concrete crushers, also referred to sometimes as controlled demolition concrete cutters or hydraulic concrete breakers. Alternatively, or in addition thereto, the rupturing means may include jacks or jackhammers or the like for breaking off chunks of rock, thereby decreasing the amount of energy consumed in breaking rock prior to transporting the rock away from the boring face and subsequently out of the tunnel.

Preferably, the second boring assembly is operatively associated with said frame and disposed axially with respect to said first boring assembly away from the annular face, said second boring assembly being operable for boring into a core face substantially parallel to said annular face, the core face being the remainder of the boring face, the drive means being operatively associated with said boring assemblies for driving said boring assemblies into the core and annular faces.

Preferably, the first and second boring assemblies include respective cutting assemblies, each having a plurality of cutting blades mounted in spaced radial relationship from one another and each mounted for cutting a substantially circumferential cut with respect to the tunnel axis, such that each cut is spaced from its adjacent cut radially. It is further preferred that at least some of the cutting assemblies are also spaced circumferentially to constitute the aforesaid plurality of cutting assemblies.

In another aspect, the present invention resides broadly in a tunnel boring machine for boring a tunnel in rock including:

locating means mounted to a frame for supporting and locating the frame in a disposition with respect to a tunnel axis and a boring face of the tunnel being bored;

a plurality of cutting blades mounted in spaced radial relationship from one another and each mounted for cutting a substantially circumferential cut with respect to the tunnel axis, such that each cut is spaced from its adjacent cut radially;

drive means operatively associated with the cutting blades for driving the cutting blades and rotating the cutting blades about the tunnel axis.

Preferably, the cutting blades are mounted for rotation about a rotation axis in substantially radial disposition with respect to the tunnel axis such that the axes of rotation occupy a common plane. Preferably, the cutting blades are mounted in substantial radial alignment with one another. More preferably, the cutting blades are mounted to a common shaft.

Preferably, a plurality of common shafts are spaced angularly from one another. In a further preferred form, a plurality of opposed pairs of angularly spaced common shafts are provided in opposed quarters of a circle circumscribed by the locating means. In such form, it is further preferred that the alternate quarters of the circle include knock-out means for knocking out rock separating the radially spaced circumferential cuts formed by the cutting blades. It is also preferred that the shafts of the cutting blades in each opposed quarter be provided as opposed shafts in substantial diametrical alignment with one another.

Some of the shafts may be arranged in pairs having a common radial axis. In such form, the pairs of shafts are provided in a common plane one with the other, but each successive pair of mounting shafts trailing angularly from the leading pair in the direction of rotation are preferably axially displaced towards the rock face to be cut by the cutting blades, whereby successively deeper cuts are made by the blades following preceding blades.

Preferably, the outermost cutting blades, when mounted for rotation about their respective mounting shafts, are convex outward from the tunnel axis, the convexity being selected according to the angle of engagement of leading edge of the cutting blade with the rock being cut from the radius from the tunnel axis.

Preferably, a radial cutting assembly is operatively associated with the frame having a plurality of cutters or notching blades arranged for cutting a circumferential groove into the circumferential face of the tunnel, preferably behind the remainder or most of the remainder of the tunnel boring machine. In such form, a ring beam is also operatively associated with the frame, the ring beam including one or more radially projecting protuberances sized to fit into the circumferential groove. The groove may be spiral in form, but it is preferred that a plurality of circumferential grooves be provided at regularly spaced intervals axially along the tunnel wall. The ring beam preferably includes thrusters for providing an axial thrust to the frame of the tunnel boring machine to assist in driving the tunnel boring machine against the cutting face.

BRIEF DESCRIPTION OF THE DRAWINGS

In order that the invention may be more readily understood and put into practical effect, a provisional embodiment of the present invention will now be described with reference to the following drawings, and wherein.

DETAILED DESCRIPTION OF THE DRAWINGS

Figure 1:
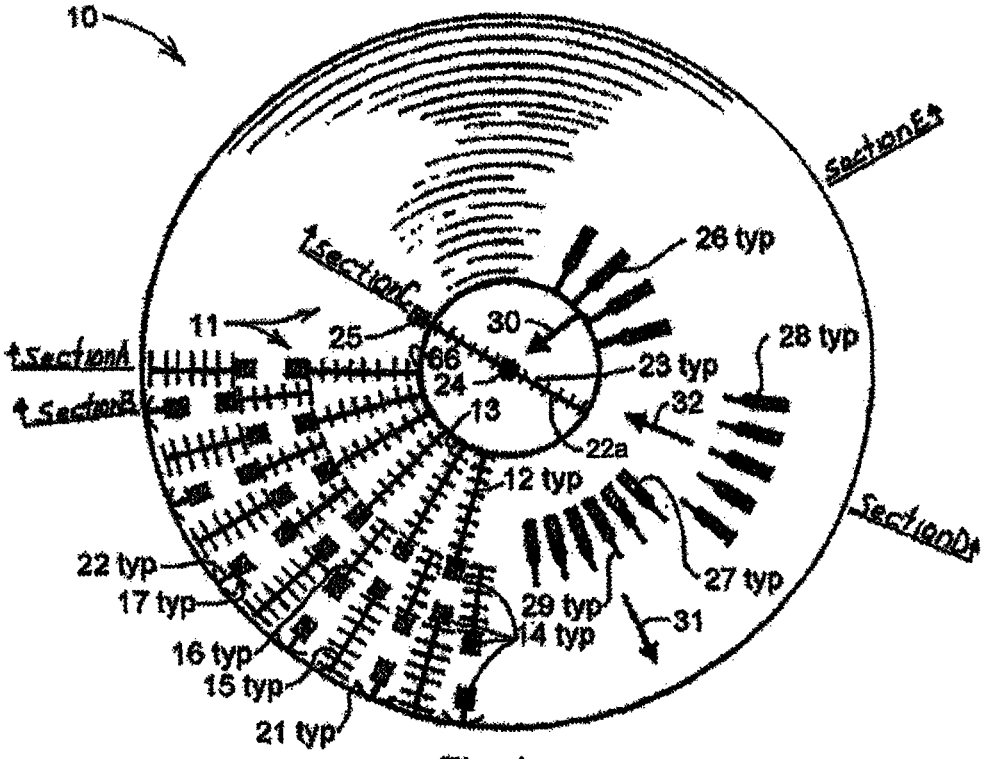
FIG. 1 is a diagrammatic end view of a rock cutting assembly for a tunnel boring machine according to the invention.
Figure 2:
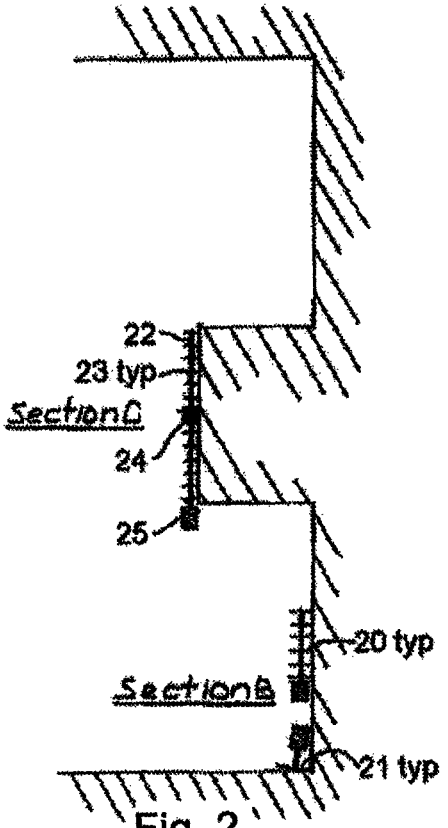
FIG. 2 is a diagrammatic side view of a tunnel being bored by the rock cutting assembly of FIG. 1 and showing the disposition of some of the parts thereof on Sections B-B and C-C of FIG. 1.
Figure 3:
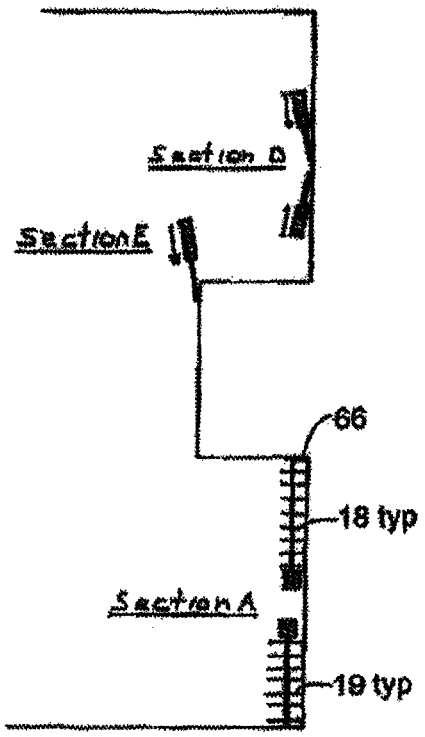
FIG. 3 is a diagrammatic side view similar to that of FIG. 2 and showing further Sections A-A, D-D and E-E of the tunnel boring machine of FIG. 1.

The tunnel boring machine 10 includes a cutting head on which is mounted rock cutting assembly 11 (illustrated in FIGS. 1 to 3) which includes six inner spoke members shown typically at 12 at regularly spaced angular intervals one from the other and each mounted for rotation about a radial axis, the radial axes being radial to the axis of travel of the tunnel boring machine. Each inner spoke member is mounted between a core member 13 and a drive motor shown typically at 14.

The rock cutting assembly also includes six outer spoke members shown typically at 15 at regularly spaced angular intervals one from the other and each mounted for rotation about a radial axis, the radial axes being radial to the axis of travel of the tunnel boring machine and in substantial radial alignment with the axes of the inner spoke members. Each outer spoke member is mounted between an outer support (not shown) and a drive motor shown typically at 14.

The rock cutting assembly also includes six intermediate outer spoke members shown typically at 16 at regularly spaced angular intervals one from the other and each mounted for rotation about a radial axis, the radial axes being radial to the axis of travel of the tunnel boring machine and angularly intermediate the axes of the inner and outer spoke members. Each intermediate spoke member is mounted between an intermediate support (not shown) and a drive motor shown typically at 14.

The rock cutting assembly also includes six wall shaping assemblies shown typically at 17 at regularly spaced angular intervals one from the other and each mounted for rotation about a radial axis, the radial axes being radial to the axis of travel of the tunnel boring machine and in substantial radial alignment with the axes of the intermediate spoke members. Each outer spoke member is mounted to a drive motor shown typically at 14 and extends outwardly therefrom.

Each of the spoke members includes a shaft to which a plurality of cutting blades is mounted, the shafts with the blades mounted thereon being driven by respective drive motors 14. The cutting blades have different diameters seen more readily in FIGS. 2 and 3. Each inner spoke member has nine inner cutting blades shown typically at 18. Each outer spoke member has seven outer cutting blades shown typically at 19. Each intermediate spoke member has six intermediate cutting blades shown typically at 20. The number of cutting blades 18, 19 and 20 shown is for clarity of the drawing only, and would be significantly higher than that shown. It will be appreciated that cutting wheels of the type envisaged are used to cut rock and methods of mounting and driving such cutting wheels will be understood by the skilled addressee.

Each wall shaping assembly includes a wall shaping blade shown typically at 21 mounted to the end of a stub shaft 22. The wall shaping blades are formed from segment of a sphere or spheroid (oblate or prolate), the convex side arranged outwardly. The stub shafts are arranged at an angle to a radial plane of the axis of the direction of travel of the tunnel boring machine, the angle being selected such that the periphery of each shaping blade cuts substantially in alignment with the direction of travel of the tunnel boring machine. Moreover, the angle of the stub shafts to the radial plane may be adjusted to permit the wall shaping blades to turn the direction of the tunnel being cut.

The outer cutting blades have a larger diameter than the intermediate cutting blades which in turn have a large diameter than the inner cutting blades. In order to accommodate the different diameters of the cutting blades, yet provide an arrangement which produces a substantially radially aligned cut face, the inner, intermediate and outer spoke members are stepped axially from one another.

Figure 11:
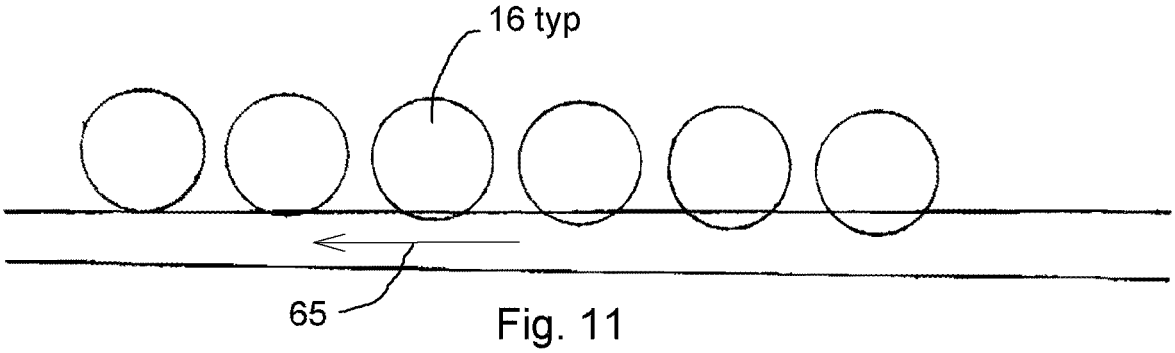
FIG. 11 is a diagrammatic representation of the arrangement of the cutting wheels in relation to the rock being cut by the rock tunnel machine according to the invention.

The spoke members are formed in to six cutting blade sets, a set being constituted by an inner, outer and intermediate spoke member, the stub shaft of a corresponding wall shaping assembly and the associated cutting blades. Each cutting blade set is each stepped axially from the set leading and/or following angularly. The stepped arrangement is arranged for each set to cut successively deeper into the rock face in the direction of rotation of the rock cutting assembly shown diagrammatically in FIG. 11 by arrow 65.

It will be seen that the sets of cutting blades extend about one quarter, or 90° of arc, about the circle of the rock cutting assembly. The cutting blade sets are duplicated in the diametrically opposite quarter of the circle, but not shown in the drawings so that the other elements of the rock cutting assembly can be depicted with greater clarity.

The rock cutting assembly also includes a core spoke member 22*a* extending diametrically across the core member 13. Six core cutting blades shown typically at 23 are mounted to each radial end of the core spoke members in regularly spaced relationship to one another. A central cutter 24 is mounted to the centre of the core spoke member to span across the axis of rotation of the rock cutting assembly. The core spoke member is rotated about its axis by a core drive motor 25 in much the same manner as the outer spoke members.

In the alternate opposed quarters of the circular space between the collective sets of cutting blades, there are provided hammer assemblies as described hereinafter. Again, such hammer assemblies are shown as for only one of the opposed quarters.

The rock cutting assembly includes four core hammers shown typically at 26 at regularly spaced angular intervals one from the other and each mounted for radial motion in the direction of arrow 30 along a radial axis from the core member to the limit of the central cutter. The rock cutting assembly also includes six outwardly directed hammers shown typically at 27 and five inwardly directed hammers shown typically at 28. Again, these hammers are at regularly spaced angular intervals one from the other and each mounted for radial motion along a radial axis. The outwardly directed hammers are mounted for movement outward along arrow 31 from an inward position to or towards the outer wall and the inwardly directed hammers are mounted for movement inward along arrow 32 from an outer position towards the core member. The inner and outer positions of the outwardly and inwardly directed hammers respectively are selected so that there is some overlap in the available travel of the heads of the hammers (shown typically at 29) across the circular slots cut by the cutting blades.

As an alternative to the arrangement of the hammers just described, the banks of hammers may be mounted for movement substantially parallel to one another, for example, symmetrically about a common radial axis or parallel to a leading or a trailing common radial axis.

Figure 4:
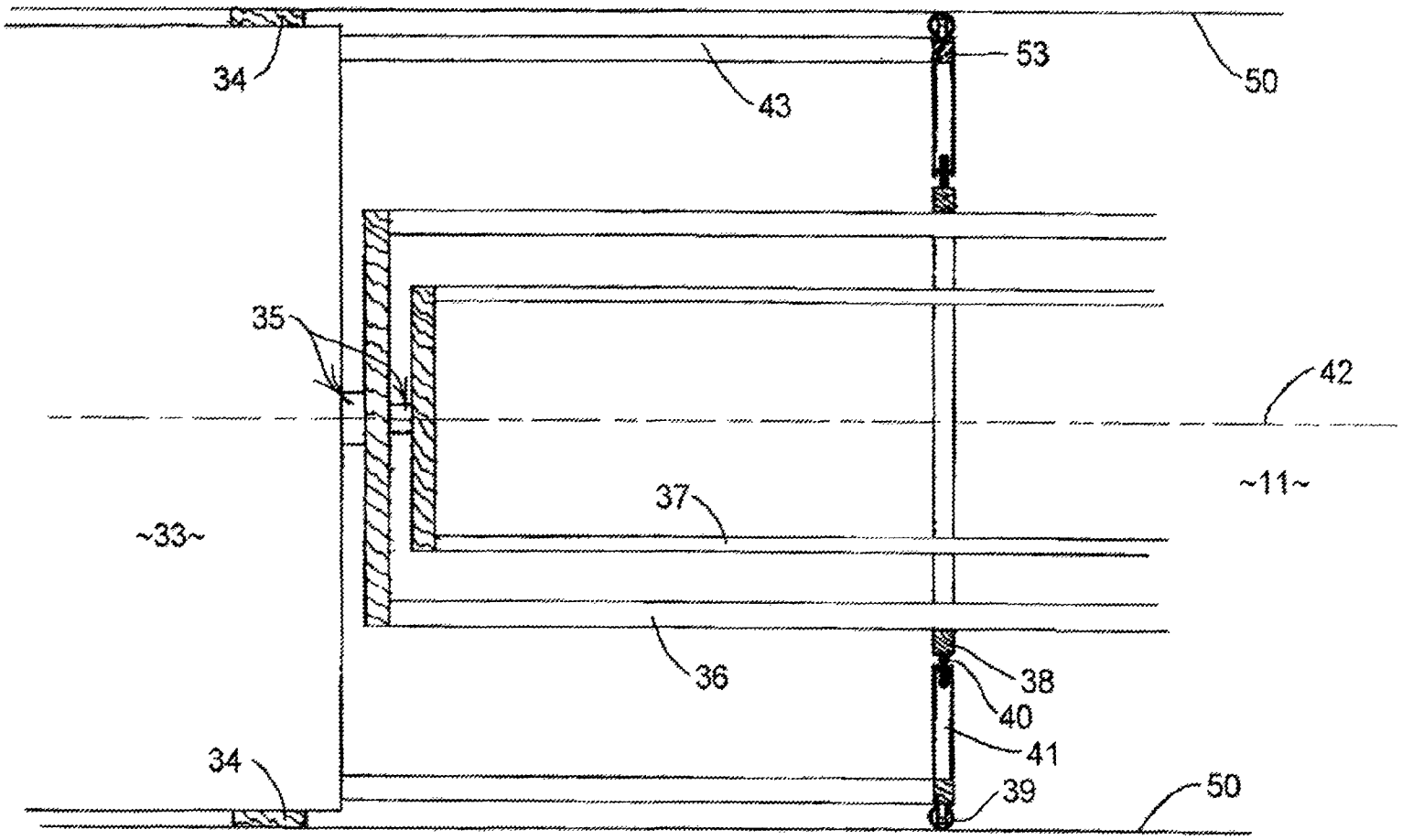
FIG. 4 is a diagrammatic sectional view showing further a frame assembly associated with the rock cutting assembly of FIG. 1.
Figure 6:
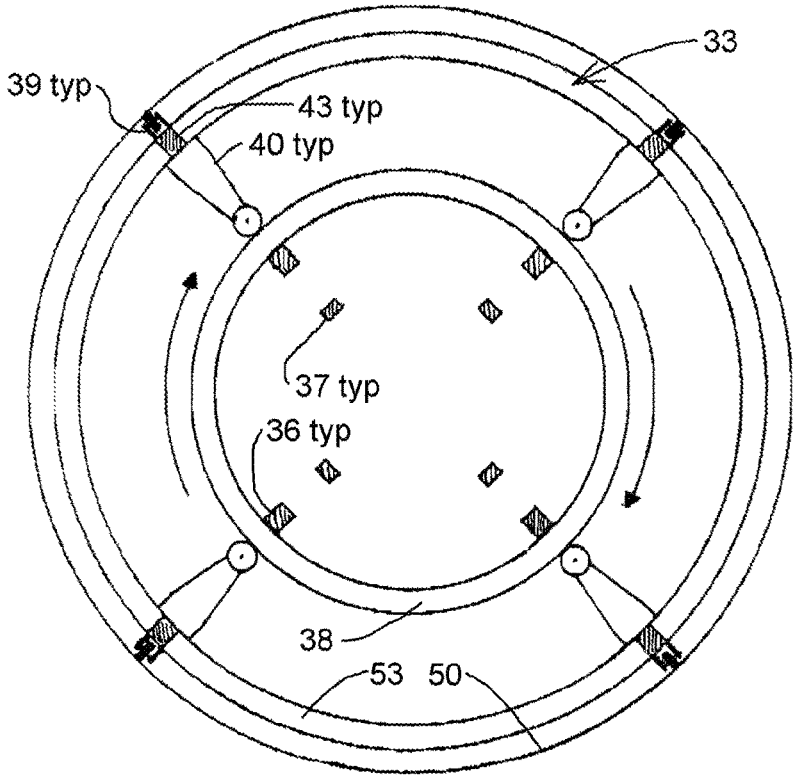
FIG. 6 is a diagrammatic end view showing parts of a piloting assembly associated with the rock cutting assembly of FIG. 1 pertaining to navigation or piloting the tunnel boring machine.
Figure 7:
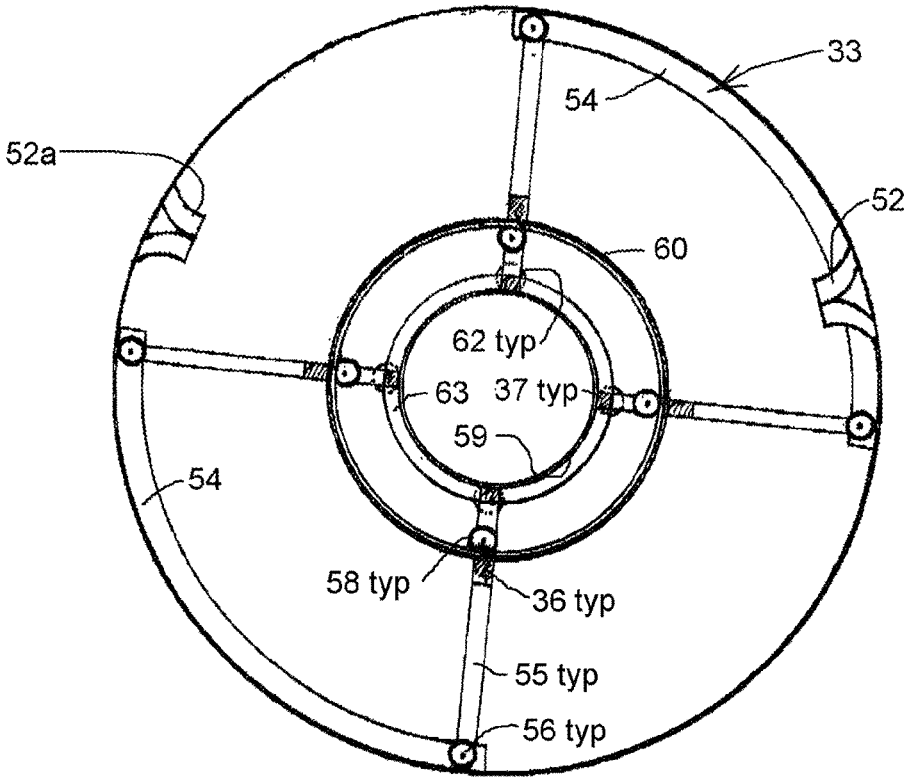
FIG. 7 is a diagrammatic end view showing further parts of the piloting assembly of FIG. 6.
Figure 8:
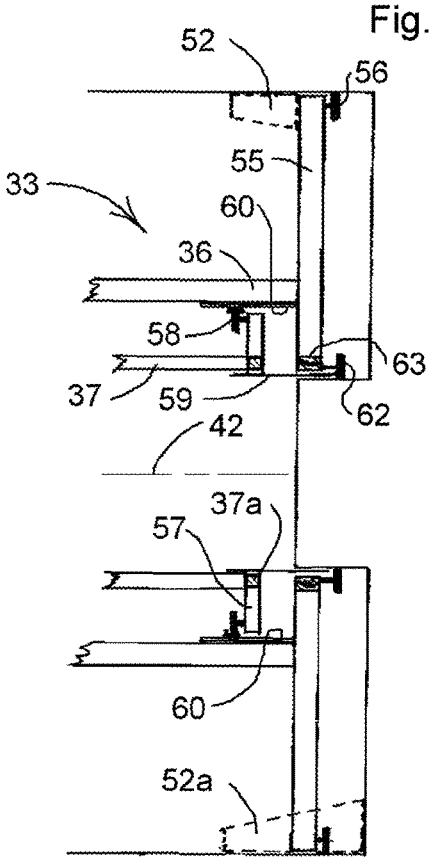
FIG. 8 is a diagrammatic sectional view showing parts of the rock cutting assembly of FIG. 7.
Figure 9:
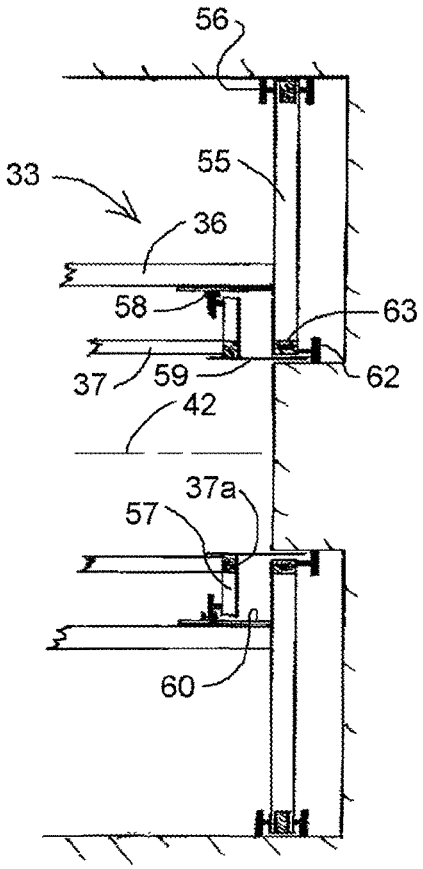
FIG. 9 is a diagrammatic sectional view showing further parts of the rock cutting assembly of FIG. 7.
Figure 10:
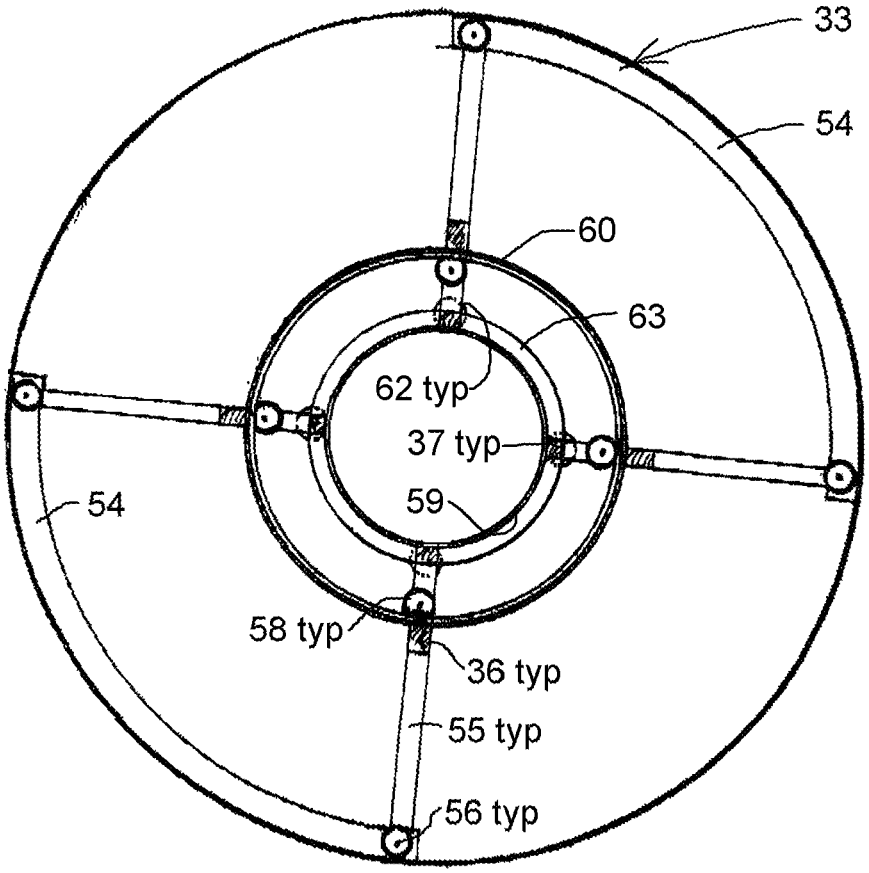
FIG. 10 is a diagrammatic end view showing the arrangement of the pilot assembly of FIG. 7.

The rock cutting assembly is operatively associated with a support structure 33 shown generally in FIGS. 4 and 6 to 10. The support structure and other elements illustrated in FIGS. 4, 8 and 9 are substantially symmetrical about a central axis 42. It will be appreciated that where reference numerals indicate one element, the corresponding element across the line of symmetry is also indicated. FIGS. 4 and 6 illustrate one end of the support structure remoter from the rock face being cut and FIGS. 7 to 10 illustrate the other end of the support structure which is closer to the rock face being cut by the cutting assembly.

The support structure is held in position by hydraulic rams and pads 34 interposed between the support structure and the wall of the previously bored tunnel for locating the support structure in a desired position with respect to the tunnel axis. The support structure is operatively connected to the rock cutting assembly by an articulated joint 35.

The rock cutting assembly (or cutting head) includes an outer frame assembly 36 and an inner frame assembly 37 which are driven by different motors and rotate at selected rates which can be different from one another, the articulated joint providing for the different rates of rotation as against the non-rotation of the support structure.

The inner and outer frame assemblies are fixed to a steering ring 38 which is held in position in the tunnel by back-end wheels 39 oriented for longitudinal travel. A change in direction of the tunnel being cut is effected by adjusting hydraulic rams 40 interposed between the steering ring and a strut 41. The strut is interposed between the hydraulic ram and the back-end wheels to accommodate the compressive load therebetween. The rock cutting assembly is further stabilised against the support structure by stabilising members 43 and a stabilising ring member 53.

Referring in particular to the other end of the support structure shown in FIGS. 7 to 10, the inner frame assembly 37 includes four stub struts 57 extending radially outward from the end of the inner frame assembly and an attached inner frame ring 37*a*, each to terminate with an intermediate stabilising wheel 58. The stub struts are also attached to a debris shield 59. This arrangement stabilises the inner frame assembly with respect to the outer frame assembly nearer the rock face being cut by the rock cutting assembly as well as preventing debris from the annular cut impinging on the cutting of the core. The intermediate stabilising wheel is in rolling engagement with an outer shield 60 which forms a cylindrical wall in fixed disposition with respect to the outer frame assembly.

The outer frame assembly 36 has four annulus alignment struts 55 extending radially inward and outward from the end of the outer frame assembly. The inner ends of the annulus alignment struts are attached to a circular core surrounding ring member 63. At or near each junction of the annulus alignment strut and the core surrounding ring member there is provided an inner stabilising wheel 62 mounted for rolling engagement with the cylindrical cut face of the core. The other end of each annulus alignment strut is attached to a respective end of one of two quarter-round peripheral members 54. At or near each junction of the annulus alignment strut and the quarter-round peripheral members there is provided an outer stabilising wheel 56 mounted for rolling engagement with the wall of the tunnel being bored.

Figure 5:
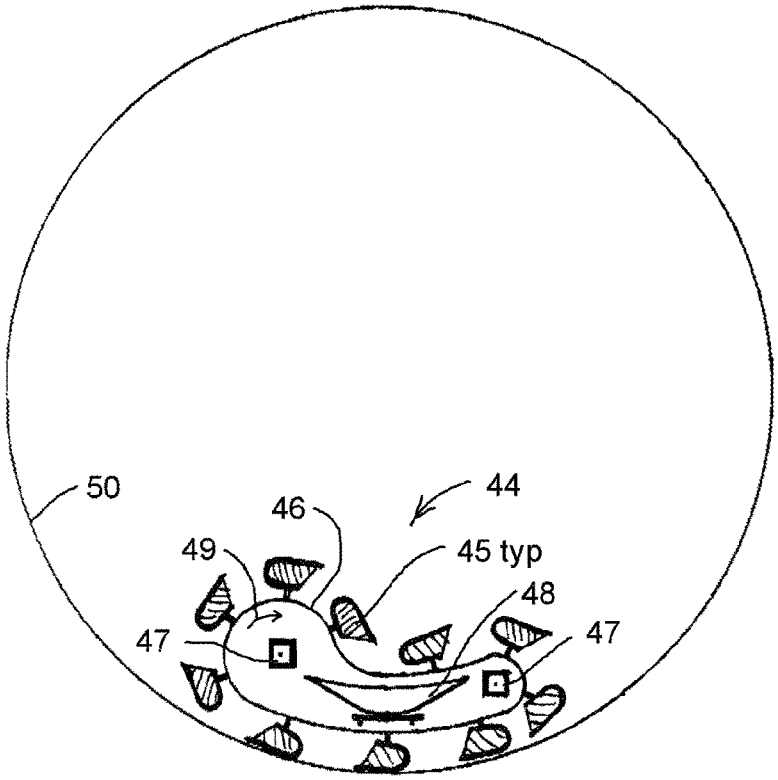
FIG. 5 is a diagrammatic end view showing parts of a collecting assembly associated with the rock cutting assembly of FIG. 1 for the collection of cut rock.

The support structure also supports a debris removal assembly 44 shown in FIG. 5. The debris removal assembly includes ten buckets shown typically at 45 mounted to a conveyor chain 46 for movement in the direction of arrow 49. The conveyor chain is looped between two sprockets 47 or the like, one being a drive sprocket and the other an idler sprocket. When the conveyor chain is rotated, the buckets follow the course of the conveyor chain to pick up debris that has fallen to the base of the tunnel. The shape of the buckets is selected to enable material to be scraped up from the wall of the tunnel 50, lifted and dumped onto a conveyor belt 48 to be carried away from the rock face being bored.

The debris removal assembly works in conjunction with sets of scraper vanes 52 arranged in evenly spaced angular relationship about the periphery of the support structure. The scraper vanes are provided in a number of sets, two being shown, one of which is mounted behind one of the quarter-round peripheral members and the other (having reference number 52*a*) being mounted for proximal engagement with the rock face being cut by the rock cutting assembly.

Figure 12:
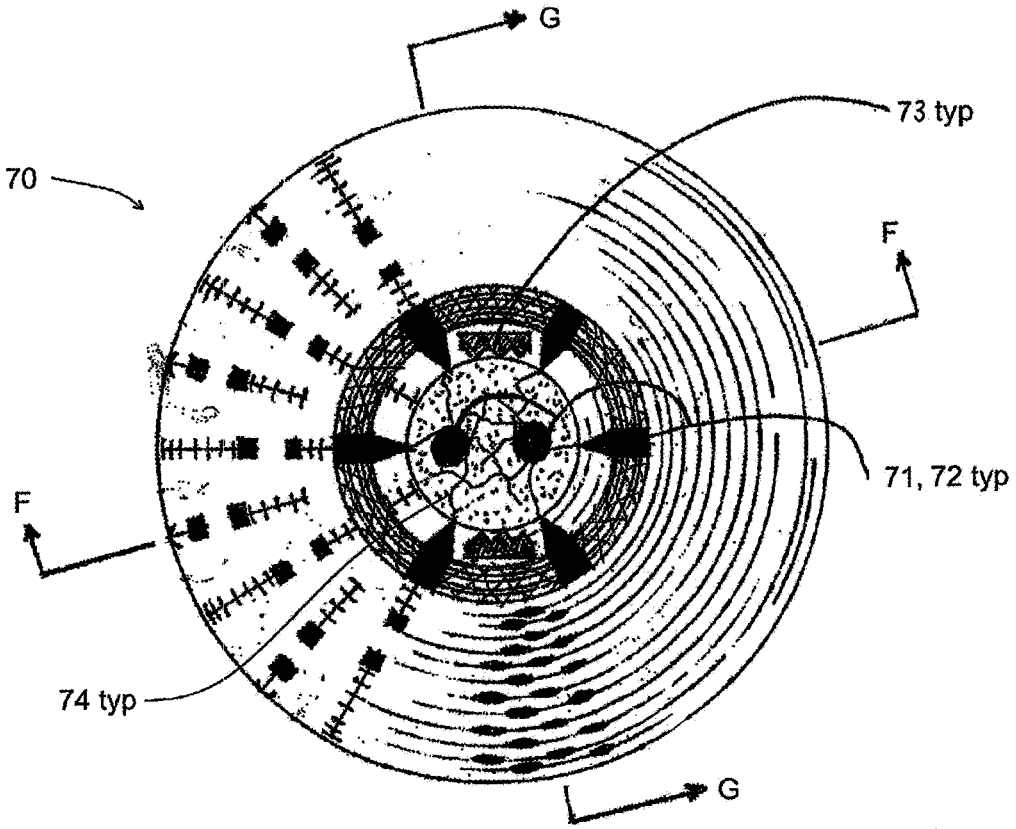
FIG. 12 is a diagrammatic end view of an alternative rock cutting assembly for a tunnel boring machine according to the invention.
Figure 13:
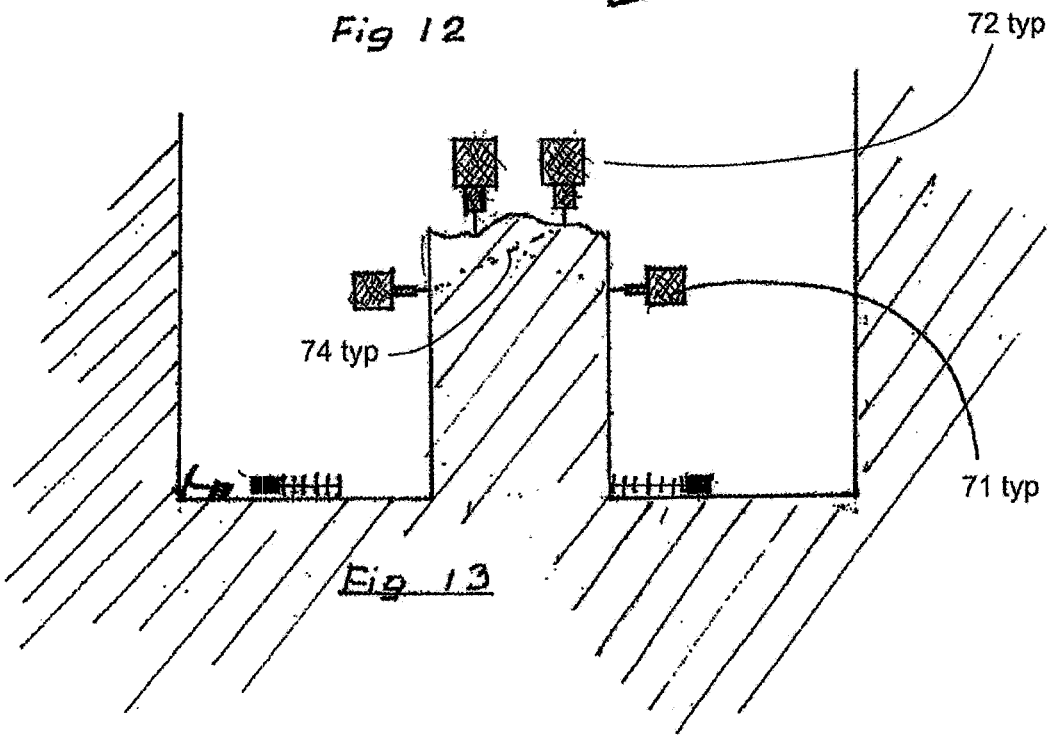
FIG. 13 is a diagrammatic side view of the tunnel being bored by the tunnel boring machine of FIG. 12 along section G-G.

The alternative cutting assembly 70 illustrated in FIGS. 12 to 14 has the same or similar arrangement of parts for the annular cut described with reference to FIGS. 1 to 11, the reference numerals being omitted for clarity. The core, however, instead of being cut by cutting assemblies has opposed pairs of circumferential rock crushers shown typically at 71, opposed jaw rock crackers shown typically at 72 and two axial rock crushers 73. The rock crushers crush the rock of the core along fracture lines shown typically at 74. The rock crackers crack off large chunks of rock by way of a radially directed fracturing force applied to opposed sides of the core.

Figure 14:
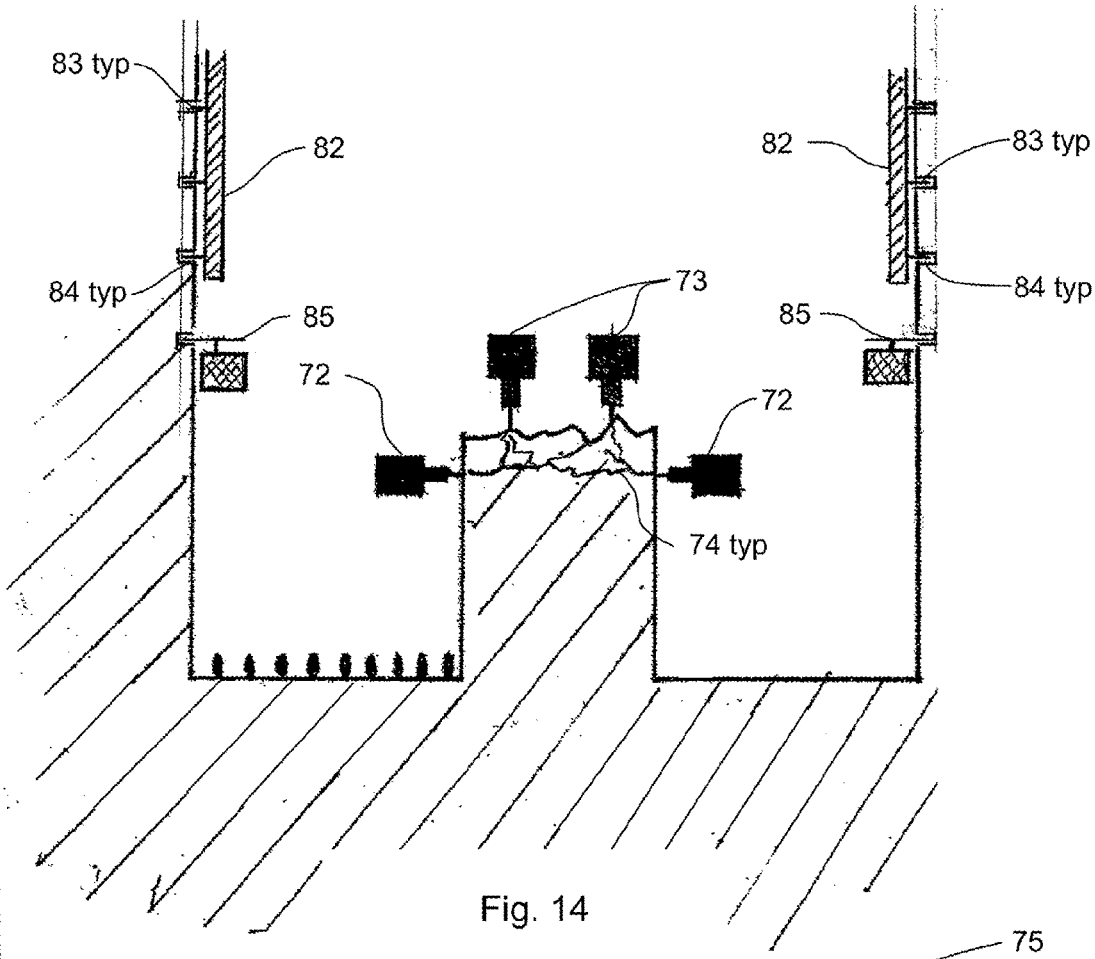
FIG. 14 is a diagrammatic side view showing notching blades with respect to the tunnel being bored.

Also shown in particular detail in FIG. 14 is a ring beam having a plurality of radially extending, axially spaced protuberances 83. The protuberances fit into a circumferential groove 84 cut by the prior passage of notch cutting blades 85. The ring beam takes an axial force in reaction to thrusting of the frame of the tunnel boring machine against the rock face being bored.

Figure 15:
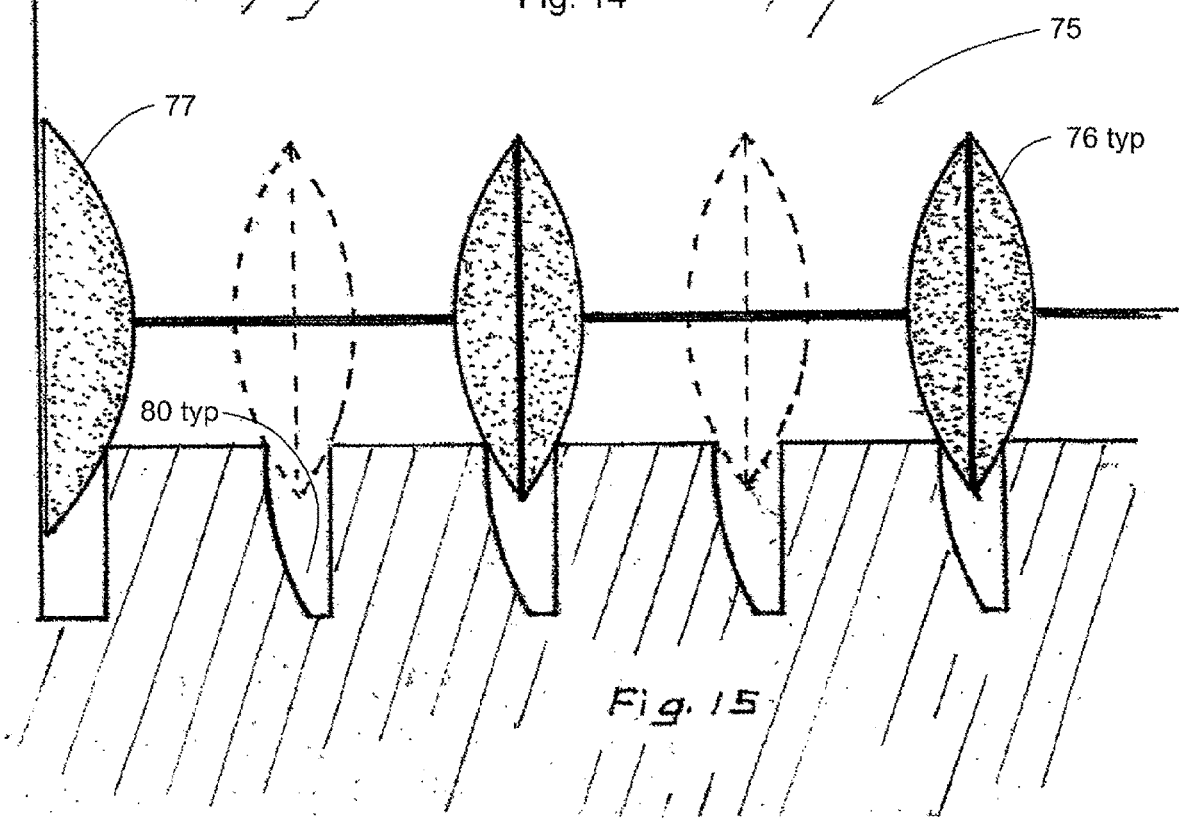
FIG. 15 is a diagrammatic side view of the cutting blades of FIG. 15.
Figure 16:
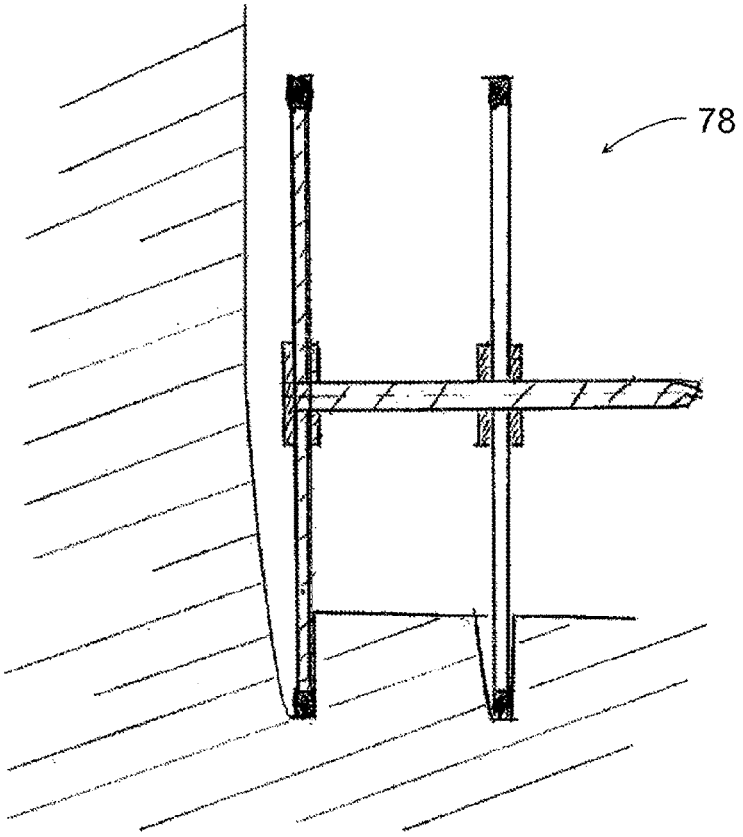
FIG. 16 is a diagrammatic side view showing peripheral edge cutters for the tunnel boring machine according to the invention.
Figure 17:
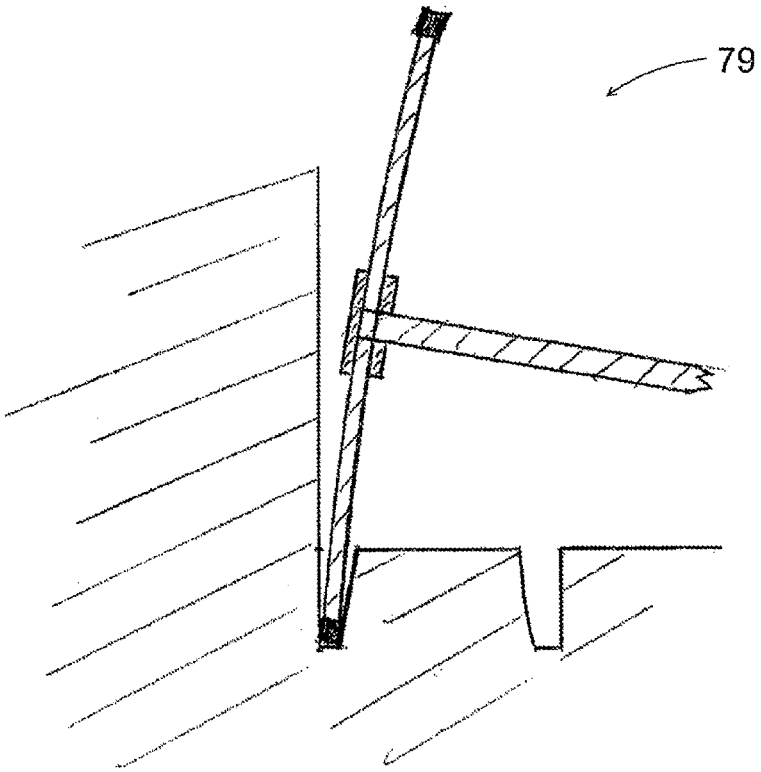
FIG. 17 is a diagrammatic side view showing an alternative peripheral edge cutter for the tunnel boring machine according to the invention.

An alternative cutting assembly 75 is illustrated in FIG. 15 having lenticular section cutting wheels shown typically at 76. A half lenticular cutting wheel 77 is on the end of the shaft against the outer wall of the tunnel, and further alternative arrangements are shown at 78 and 79 in FIGS. 16 and 17 respectively. The lenticular cutting wheels are coated with an abrasive material, but are not intended to have a predominantly abrasive function. Rather, the lenticular wheels are inserted forcefully into a previously cut channel shown typically at 80 to break off chunks of rock for removal from the boring face. The lenticular cutting wheels are provided in alternate channels to provide a lateral force against the sides of the channels to that the rock, being unsupported in the alternate channels shown typically at 81, can break off in the larger chunks as referred to above. It will be seen that the previously cut channels have a flat side and a curved side due to the path followed by respective diamond cutting blades which produce the channels.

The outermost cutting blades are configured in any one of the ways shown, the more robust arrangements not necessarily being preferred. In the arrangement illustrated in FIG. 16 in particular, the blade would have to cut to a depth half the diameter of the blade, less that of the shaft and/or mounting, such that a corresponding half the circumference of the blade would be in contact with the wall of the tunnel.

In use, the tunnel boring machine according to the present invention may be used for boring a tunnel of relatively large diameter through rock. The wall of the tunnel would be left substantially in an unfractured state, relatively smooth for the application of surface finishings or the installation of linings. The material recovered from the excavation, depending on the spacings of the diamond blades, can be of a size to be utilised as, for example, aggregate or the like. This contrasts with the debris from current tunnel boring machinery which normally becomes a waste disposal problem.

The tunnel boring apparatus of the present invention may be operated, by use of the locating means, to be moved laterally to expand the boring face by excavating another boring face or portion of a boring face. Consequently, the cross-section of the tunnel is not confined to a circular cross-section. As a consequence, tunnels having an obround, elliptical or other shape are contemplated by the tunnel boring machine according to the present invention.

The forces required to drive the cutting head forward could be less, depending on the application, which may lead to savings in power consumption. It seems that current tunnel boring machines may be limited in the diameter of the tunnel they can produce because of the forces required to drive them through the rock. It is believed the rock cutting assembly of the present invention permits larger diameter tunnels because there are fewer stresses put on the tunnel walls. Since tunnel boring machines of the prior art cause fracturing of the rock not only at the cutting face but also around the tunnel walls, it can be difficult to finish the tunnel off with linings.

Banks of diamond blades are provided as hereinbefore described, their spacing and diameter determined by the type of material to be removed. Each bank or set follows in its circular path behind a preceding bank or set by at an incremental depth so that the banks of blades follow one another in a spiral fashion through the rock.

In the large cut section, the outside is inscribed by a convex blade which follows the circumference, but unlike the other blades of the rock cutting assembly which scribe a cut which is offset to the outside, this blade cuts to the inside which allows for turning of the cutting head to facilitate change in direction of the tunnel.

In the large cut section, the inside cut is scribed out by a cup shaped blade 66 to allow for attaching to the very (inner) end of the drive shaft (constituted by the inner spoke member). The blades are driven by motors such as electric or hydraulic drives, the smaller internal section of the cut on a different plane than the larger outer cut and if needs be, rotated at a different rate or multiple of the rotation of the outer banks in order to achieve the same depth of cut as the outside in a given rotation of the outside banks of the cutting head. The central cutter 24 is wider than the other cutting blades in order that the centre of the tunnel be cut out so that the rock breakers (hammers) can break up to the scribed cut without damaging the cutter. Although the central cutter may be substantially cylindrical, it may be found to be more efficient if it is barrel shaped.

After the blades have passed, cutting arcuate slots into the rock face being bored into, the hammers or rock breakers are mounted at an angle to the radial plane determined by the material to be removed and may proceed with multiple passes until the surface is scrabbled down to the depth of the cuts produced by the diamond blades.

The rock cutting assembly is driven forward and rotated by a machine which may be similar in some respects to conventional tunnel boring machines insofar as its use of hydraulic rams and pads are concerned.

Although the invention has been described with reference to a specific example, it will be appreciated by those skilled in the art that the invention may be embodied in other forms within the broad scope and ambit of the invention as herein set forth and defined by the following claims.

What is claimed is:

1. A tunnel boring machine for boring a tunnel in rock including:

a support structure;

locating means operatively connected to said support structure for supporting and locating said support structure in a desired position with respect to the axis of a tunnel or a tunnel to be bored;

a boring assembly operatively connected to said support structure for forward and reverse travel relative to said support structure, said boring assembly including a cutting head arranged to rotate about the tunnel axis for boring into an annular face about a core substantially coaxial with the tunnel axis;

a core removal assembly operatively connected to said support structure and disposed axially behind said cutting head, said core removal assembly being operable for removing the core exposed by the boring assembly; and first drive means operatively connected to said boring assembly for driving said boring assembly forward relative to said support structure into or against the annular face;

wherein said cutting head includes at least one set of cutting blades mounted for rotation about an axis extending radially across said cutting head, said cutting blades being arranged in spaced radial relationship from one another, each blade being arranged to cut into the annular face a substantially circumferential cut with respect to the tunnel axis, such that each cut is radially spaced from an adjacent cut; and second drive means operatively connected to said cutting head for causing rotation of said cutting head about the tunnel axis; and third drive means operatively connected to said at least one set of cutting blades for causing rotation of said at least one set of cutting blades about its radial axis.

2. A tunnel boring machine according to claim 1, wherein said at least one set of cutting blades includes a plurality of sets arranged such that in use the blades of one set follow the same substantially circumferential cuts made by a previous set thereby increasing the depth of the previous cuts.

3. A tunnel boring machine according to claim 2, wherein the axes of rotation of the blades in each set are substantially in the same plane.

4. A tunnel boring machine according to claim 3, wherein the axes of rotation of selected successive sets of blades are forward of the previous set by a predetermined angle or distance.

5. A tunnel boring machine according to claim 1, including knock-out means for knocking out rock between adjacent radial spaced circumferential cuts when the cuts have reached a predetermined depth.

6. A tunnel boring machine according to claim 5, wherein said knock-out means includes wheels adapted to roll in the circumferential cuts and break off the rock between adjacent circumferential cuts.

7. A tunnel boring machine for boring a tunnel in rock including:

a support structure;

locating means operatively connected to said support structure for supporting and locating said support structure in a desired position with respect to the axis of a tunnel or a tunnel to be bored;

a boring assembly operatively connected to said support structure for forward and reverse travel relative to said support structure, said boring assembly including a cutting head arranged to rotate about the tunnel axis for boring into an annular face about a core substantially coaxial with the tunnel axis;

wherein said cutting head includes at least one set of cutting blades mounted for rotation about an axis extending radially across said cutting head, said cutting blades being arranged in spaced radial relationship from one another, each blade being arranged to cut a substantially circumferential cut with respect to the tunnel axis such that each cut is radially spaced from an adjacent cut; and drive means operatively connected to said cutting head and said at least one set of cutting blades for causing rotation of said cutting head about the tunnel axis and said at least one set of cutting blades about its radial axis wherein said drive means drives said at least one set of cutting blades about its radial axis independently of rotation of said cutting head.

8. A tunnel boring machine according to claim 7, including a core removal assembly operatively connected to said support structure and disposed axially behind said cutting head, said core removal assembly being operable for removing the core exposed by the first boring assembly.

9. A tunnel boring machine according to claim 8, wherein said cutting head is a first cutting head and said core removal assembly includes a second cutting head arranged to rotate about the tunnel axis for boring into the core substantially coaxial with the tunnel axis.

10. A tunnel boring machine according to claim 9, wherein said second cutting head includes at least one set of cutting blades mounted for rotation about an axis extending radially across said cutting head, said cutting blades being arranged in spaced radial relationship from one another, each blade being arranged to cut a substantially circumferential cut with respect to the tunnel axis such that each cut is radially spaced from an adjacent cut; and drive means operatively connected to said second cutting head and said at least one set of cutting blades for causing rotation of said second cutting head about the tunnel axis and said at least one set of cutting blades about its radial axis.

11. A tunnel boring machine according to claim 8, wherein said core removal assembly includes a core rupturing assembly for rupturing the core into rock fragments of a predetermined size.

12. A tunnel boring machine according to claim 11, wherein said predetermined size is greater than the size of rock fragments produced by the boring assembly.

13. A tunnel boring machine according to claim 11, wherein said core rupturing assembly includes hammers or pincers.

14. A tunnel boring machine according to claim 7, wherein said at least one set of cutting blades includes a plurality of sets, the blades of each set being mounted on a common shaft and arranged such that in use the blades of one set follow the same substantially circumferential cuts made by a previous set to increase the depth of the previous cuts to a predetermined depth.

15. A tunnel boring machine according to claim 14, wherein the blades of each set are arranged to increase the depth to the predetermined depth within about one quarter to one half of a revolution of the cutting head.

16. A tunnel boring machine according to claim 15, wherein the axes of rotation of selected successive sets of blades are axially displaced whereby the blades of successive sets make deeper cuts.

17. A tunnel boring machine according to claim 15, including at least one set of knock-out means arranged to follow a predetermined number of sets of blades for knocking out rock between adjacent radial spaced circumferential cuts when the cuts have reached the predetermined depth.

18. A tunnel boring machine according to claim 17, wherein said knock-out means are arranged in sets with about one set per quarter of a revolution of the cutting head.

19. A tunnel boring machine according to claim 18, wherein said knock-out means includes wheels adapted to roll in the circumferential cuts and break off the rock between adjacent circumferential cuts.

20. A tunnel boring machine for boring a tunnel in rock including:

a support structure;

locating means operatively connected to said support structure for supporting and locating said support structure in a desired position with respect to the axis of a tunnel or a tunnel to be bored;

a boring assembly operatively connected to said support structure for forward and reverse travel relative to said support structure, said boring assembly including a cutting head arranged to rotate about the tunnel axis for boring into an annular face about a core substantially coaxial with the tunnel axis;

wherein said cutting head includes at least one set of cutting blades mounted for rotation about an axis extending radially across said cutting head, said cutting blades being arranged in spaced radial relationship from one another, each blade being arranged to cut a substantially circumferential cut with respect to the tunnel axis such that each cut is radially spaced from an adjacent cut;

drive means operatively connected to said cutting head and said at least one set of cutting blades for causing rotation of said cutting head about the tunnel axis and said at least one set of cutting blades about its radial axis;

a core removal assembly operatively connected to said support structure and disposed axially behind said cutting head, said core removal assembly being operable for removing the core exposed by the first boring assembly; and wherein said cutting head is a first cutting head and said core removal assembly includes a second cutting head arranged to rotate about the tunnel axis for boring into the core substantially coaxial with the tunnel axis;

wherein said second cutting head includes at least one set of cutting blades mounted for rotation about an axis extending radially across said cutting head, said cutting blades being arranged in spaced radial relationship from one another, each blade being arranged to cut a substantially circumferential cut with respect to the tunnel axis such that each cut is radially spaced from an adjacent cut; and drive means operatively connected to said second cutting head and said at least one set of cutting blades for causing rotation of said second cutting head about the tunnel axis and said at least one set of cutting blades about its radial axis.

21. A tunnel boring machine for boring a tunnel in rock including:

a support structure;

locating means operatively connected to said support structure for supporting and locating said support structure in a desired position with respect to the axis of a tunnel or a tunnel to be bored;

a boring assembly operatively connected to said support structure for forward and reverse travel relative to said support structure, said boring assembly including a cutting head arranged to rotate about the tunnel axis for boring into an annular face about a core substantially coaxial with the tunnel axis;

wherein said cutting head includes at least one set of cutting blades mounted for rotation about an axis extending radially across said cutting head, said cutting blades being arranged in spaced radial relationship from one another, each blade being arranged to cut a substantially circumferential cut with respect to the tunnel axis such that each cut is radially spaced from an adjacent cut;

drive means operatively connected to said cutting head and said at least one set of cutting blades for causing rotation of said cutting head about the tunnel axis and said at least one set of cutting blades about its radial axis; and wherein said at least one set of cutting blades includes a plurality of sets, the blades of each set being mounted on a common shaft and arranged such that in use the blades of one set follow the same substantially circumferential cuts made by a previous set to increase the depth of the previous cuts to a predetermined depth.

* * * * *